US006120337A

United States Patent [19]

Bautista Real et al.

[11] Patent Number: 6,120,337

[45] Date of Patent: Sep. 19, 2000

[54] LIFE-SAVING DEVICE WITH LAUNCHER

[76] Inventors: Josep Antoni Bautista Real; Rosa Maria Soriano Colomina, both of c/Ferrandiz y Belles 4, 1o1a, Girona, Spain

[21] Appl. No.: 09/066,629

[22] Filed: Apr. 24, 1998

[30] Foreign Application Priority Data

Apr. 24, 1997 [ES] Spain ..... 9700959

[51] Int. Cl.[7] ..... B63C 9/08; B63C 9/26

[52] U.S. Cl. ..... 441/88; 441/84

[58] Field of Search ..... 441/80, 81, 84, 441/85, 88, 90, 92, 94, 97, 98, 99

[56] References Cited

U.S. PATENT DOCUMENTS

| | | | |
|---|---|---|---|
| 4,799,906 | 1/1989 | Perkins | 441/85 |
| 5,584,736 | 12/1996 | Salvemini | 441/85 |
| 5,775,966 | 7/1998 | Bautista Real et al. | 441/80 |
| 5,895,300 | 4/1999 | Borrelli | 441/85 |

*Primary Examiner*—S. Joseph Morano
*Assistant Examiner*—Patrick Craig Muldoon
*Attorney, Agent, or Firm*—Lackenbach Siegel

[57] ABSTRACT

A life preserver device equipped with a launcher which affords the possibility of the immediate inflating of a float, controlling the distance to which the same is to be launched using a chart of metric notes and a telemetric gauge attached to the float and the launcher by a system of lines which enable joining the float to the roll stand of the launcher, inside the muzzle of which the float is inserted.

22 Claims, 15 Drawing Sheets

Figure 5:
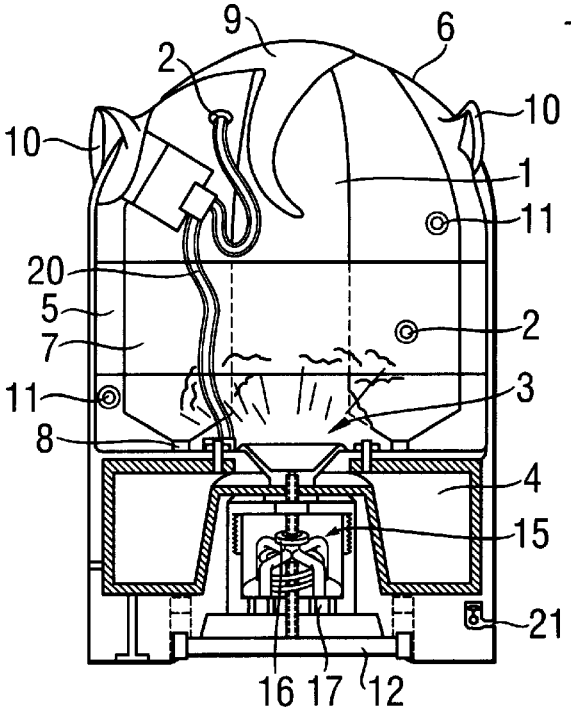

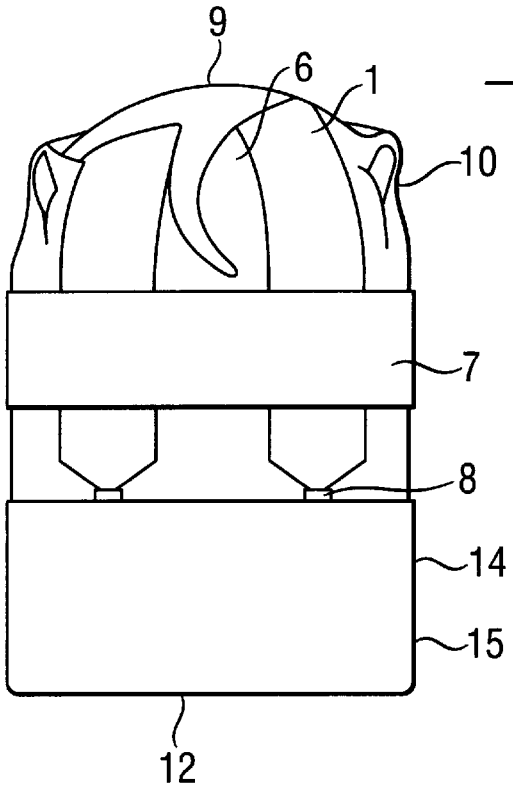
Fig. 1
Fig. 2
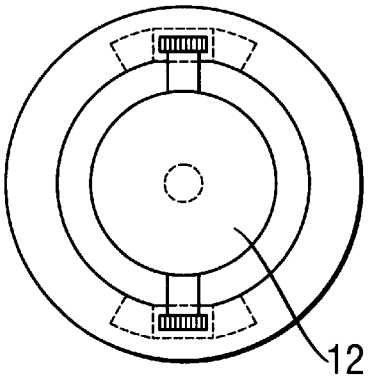
Fig. 3
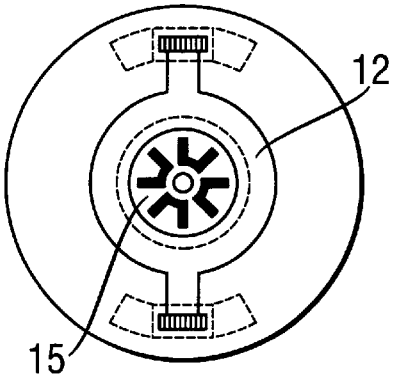
Fig. 4
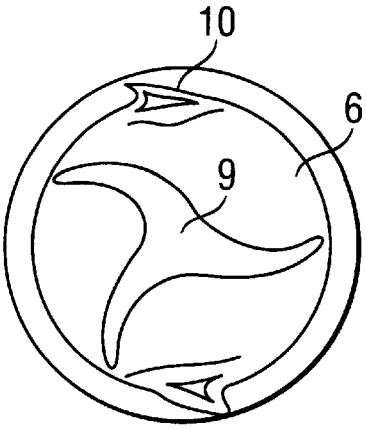

Fig. 10
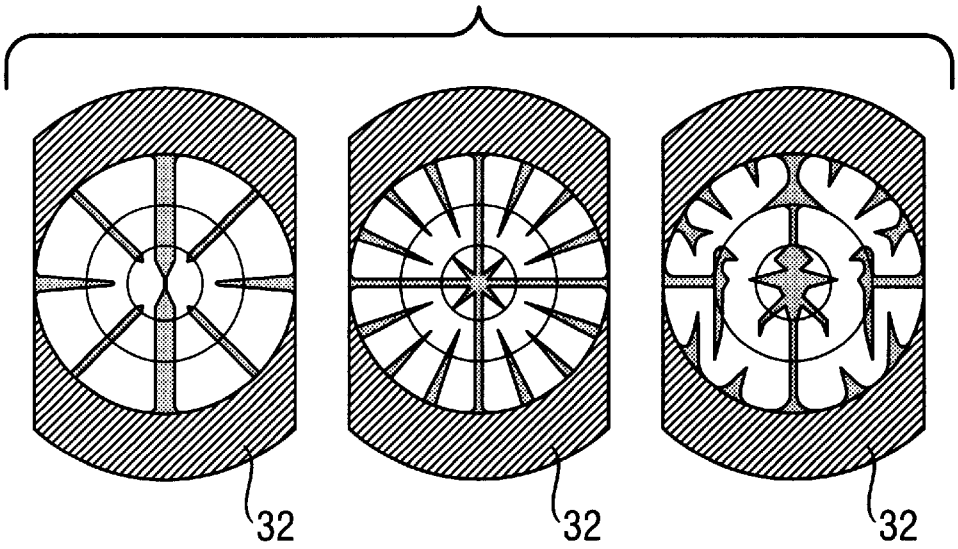
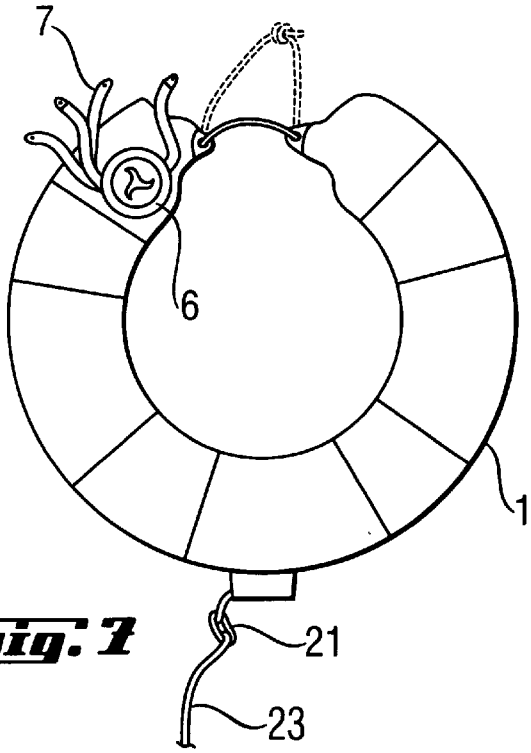
Fig. 7
Fig. 8
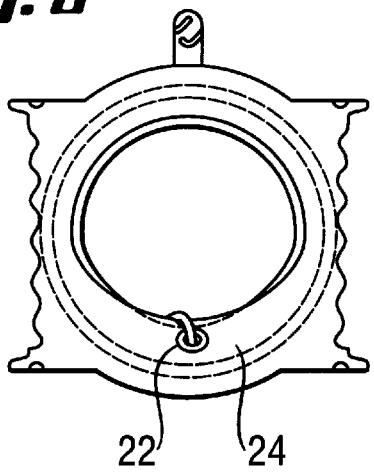
Fig. 9
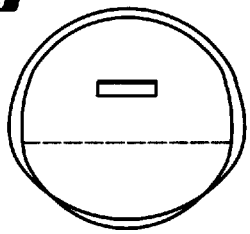

LIFE-SAVING DEVICE WITH LAUNCHER

The present application relates to improvements in a life preserver device complete with a launcher which remarkably improves upon the state of the art as known and employed to date.

The present specification and the drawings which are attached hereto entail an automatically-inflatable, folding life preserver complete with a second device which affords launching the life preserver a considerable distance, the improvements upon which comprise an evident innovation within the field of this type of item, obviously improving upon that which currently exists and providing a greater deal of safety and effectiveness as regards the use thereof.

Currently, most life preserver systems are essentially intended for use as a float of different features, but do not often incorporate an automatic inflating system and a propulsion system which affords the possibility of launching said float far enough to come to the aid of an accident victim in the water. Likewise, in the event that said launching system is indeed included, it never incorporates the necessary means for calculating the proper launching distance, which comprises a stumbling block for the rescue operation. In this regard and as concerns the float as such, it must be pointed out that most of the automatic inflating systems are extremely complex and are set into operation prior to launching the floats to the victim.

The innovation to which reference is being made herein is involved in any situation which requires the rescue of an accident victim at sea or in any similar hard-to-reach place such that it will be possible to get a life preserver to said victim for the purpose of coming to the aid thereof, regardless of the distance at which the accident victim in question is located.

This innovation is hence specifically a reusable, rechargeable, compact, small-sized, self-inflating, folding life preserver in conjunction with a launcher or gun similar to a rifle, the features of which make it the perfect tool for use an a launcher and for getting the aforementioned life preserver to the person to be rescued, said launcher likewise being actively involved in the recovery of the float and thus in the operation of picking up the victim grasping onto said float.

This life preserver is comprised of two separate main parts which, in all, comprise an entire rescue system as a whole: the life preserver float as such and the propulsion unit, launcher or gun which affords the possibility of launching it over long distances.

For a better comprehension of the invention being advocated in this report, some drawings are attached for illustrative purposes which are in no case of a restrictive or limiting nature.

FIG. 1: Front view of life preserver exterior.

FIG. 2: Detailed view of sensor.

FIG. 3: Cross-section of sensor.

FIG. 4: View of top of float.

FIG. 5: Cross-section of interior configuration of the life preserver.

Figure 6:
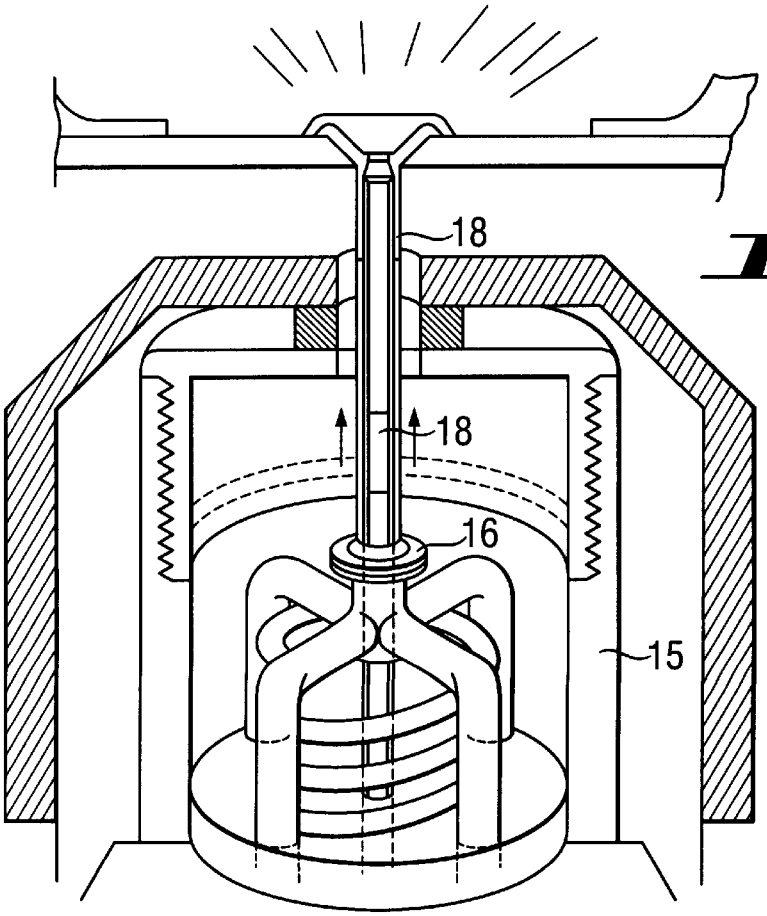

FIG. 6: Detailed cross-section of automatic life preserver inflating system.

FIG. 7: Top view of float with line joining it to launcher.

FIG. 8: Front view of roll stand.

FIG. 9: Detailed view of the snap-on cover of roll stand.

FIG. 10: Detailed view of launcher chamber filters.

Figure 11:
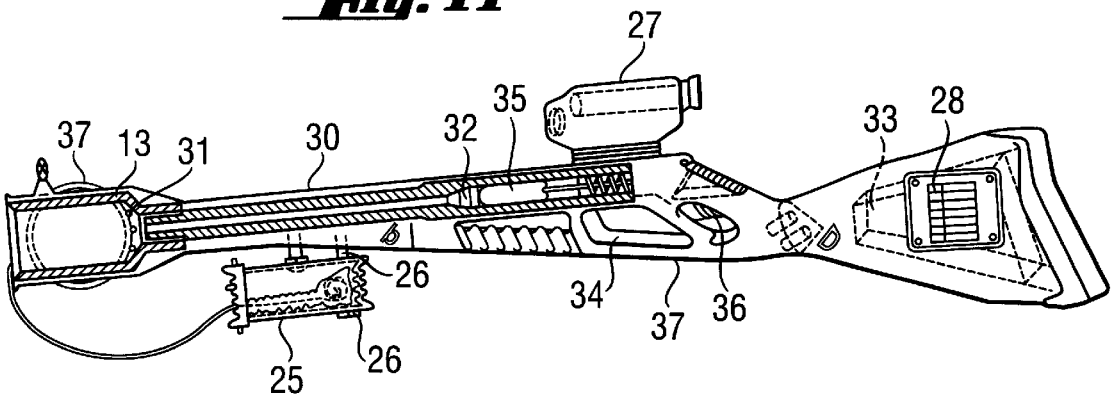

FIG. 11: Detailed cross-section of launcher.

Figure 12:
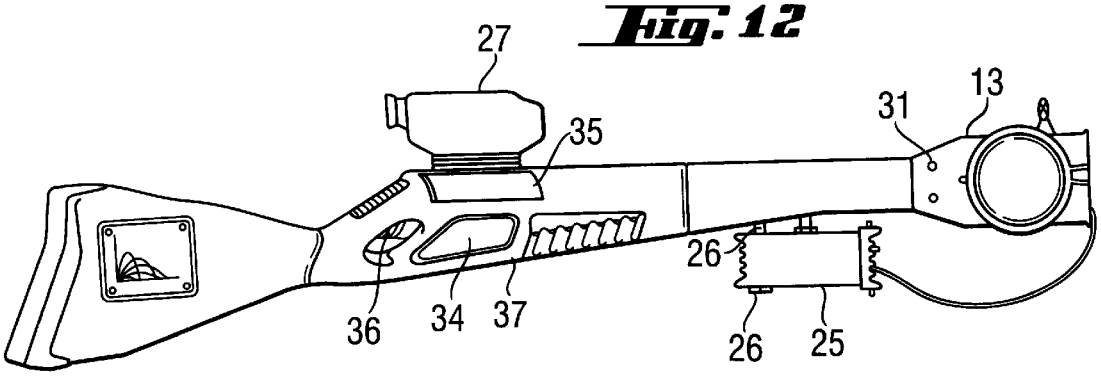

FIG. 12: Left perspective view of launcher.

Figure 13:
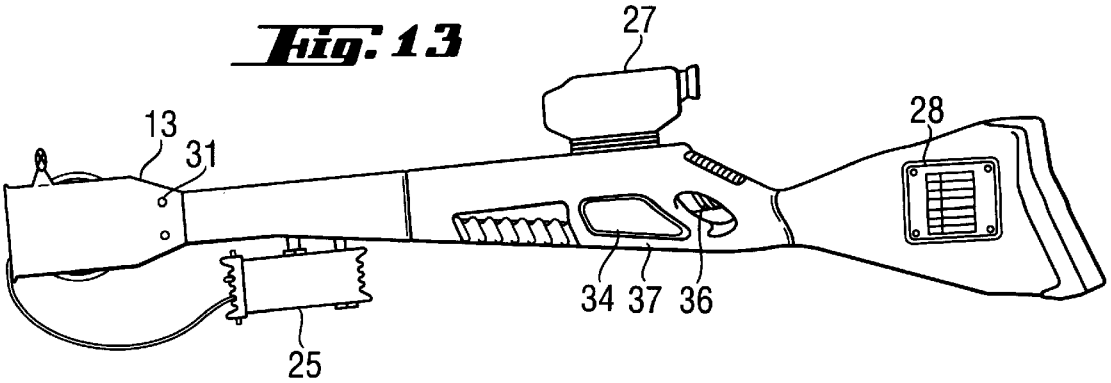

FIG. 13: Right perspective view of launcher.

Figure 14:
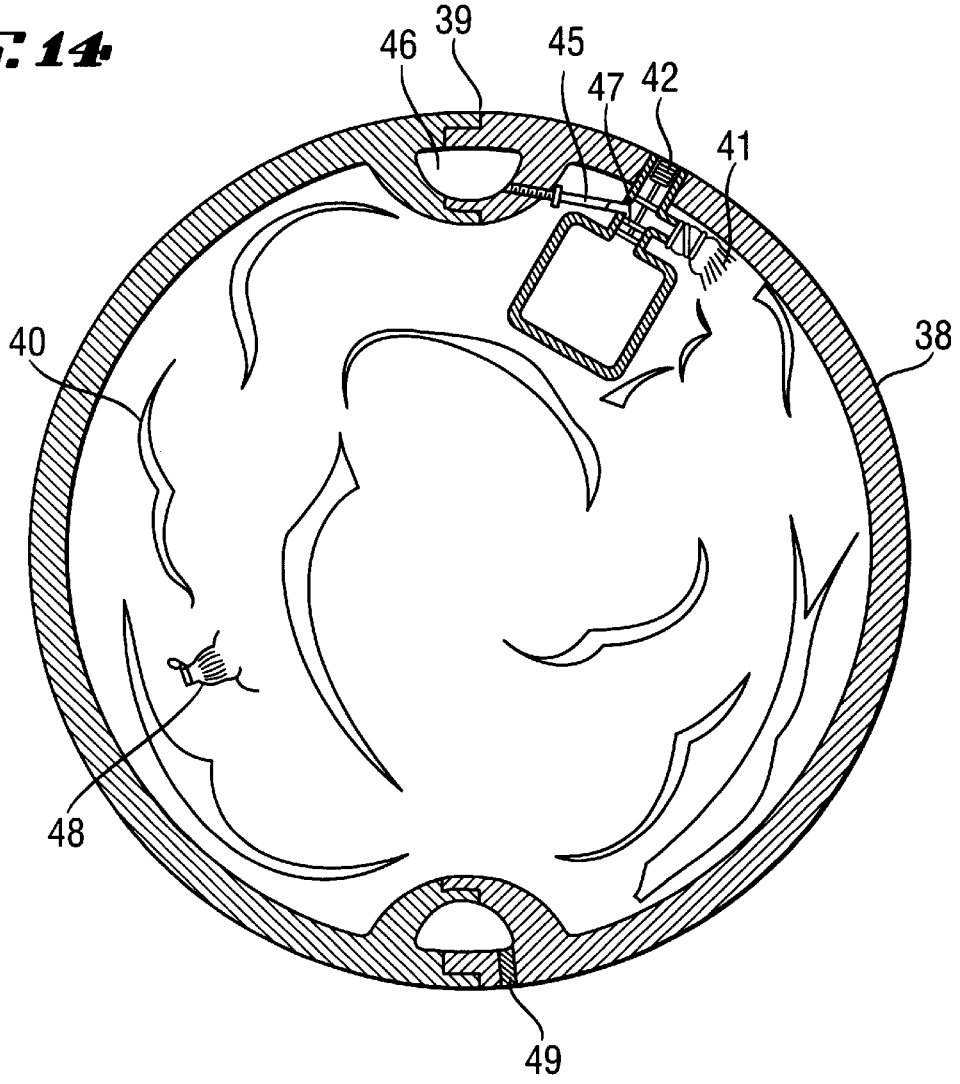

FIG. 14: View of cylindrical body of closed life preserver.

Figure 15:
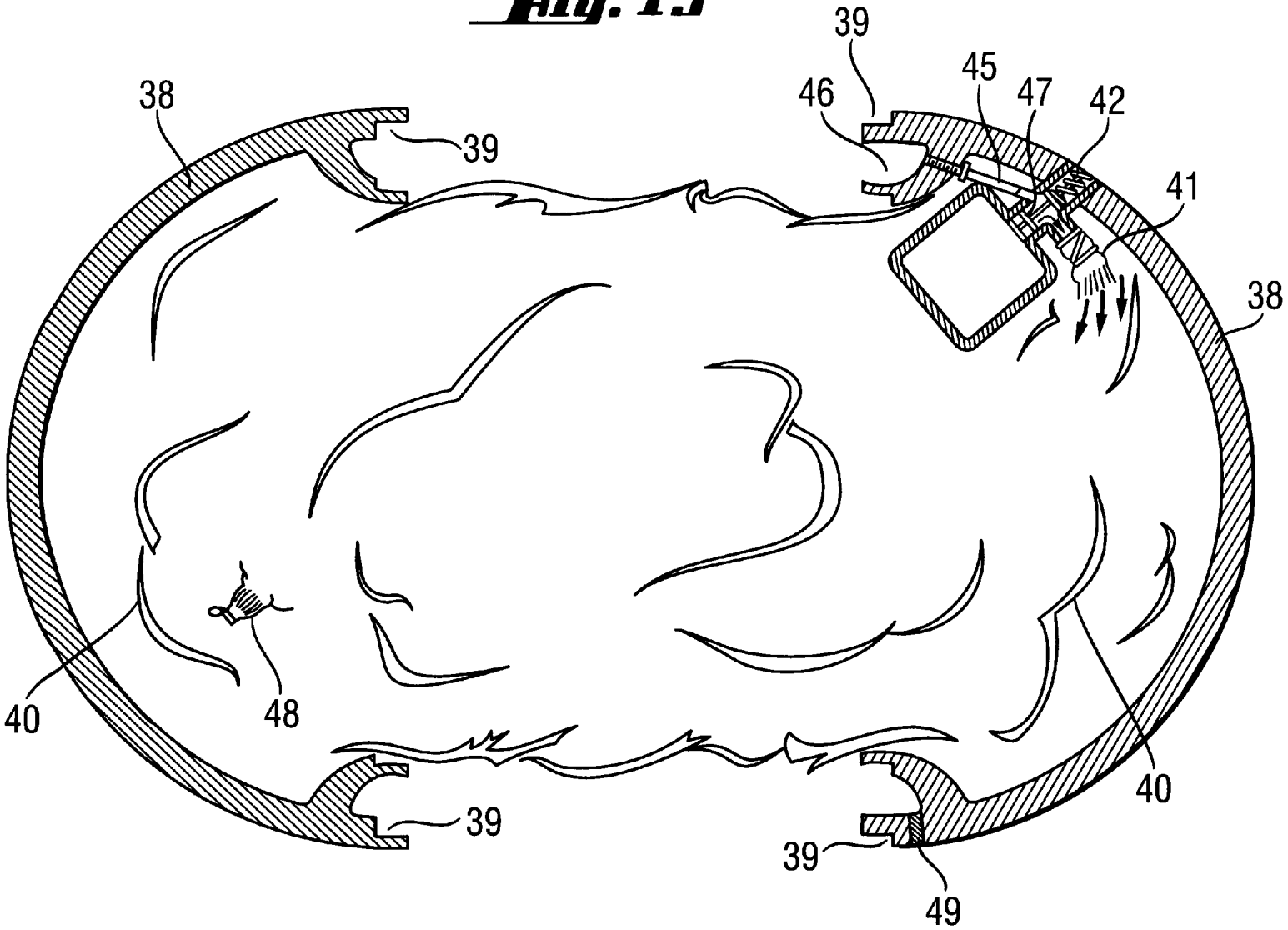

FIG. 15: View of cylindrical body of open life preserver.

Figure 16:
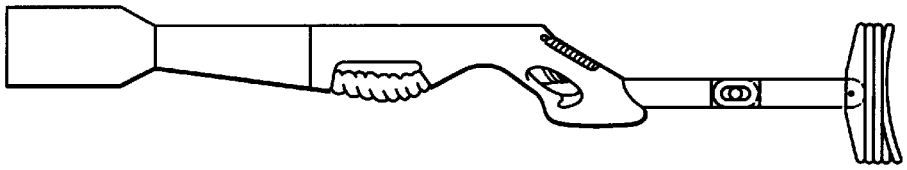
Figure 17:
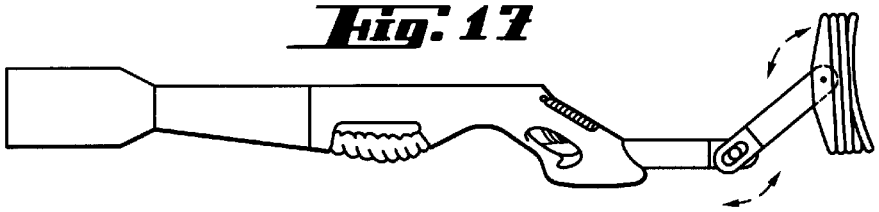

FIG. 16 & FIG. 17: View of launcher with folding, hinged butt.

Figure 18:
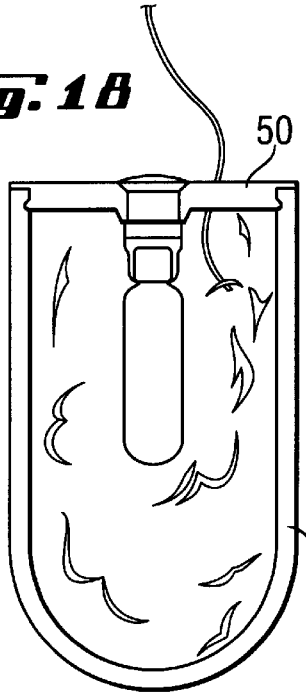

FIG. 18: View of cylindrical body of life preserver without side openings, closed.

Figure 19:
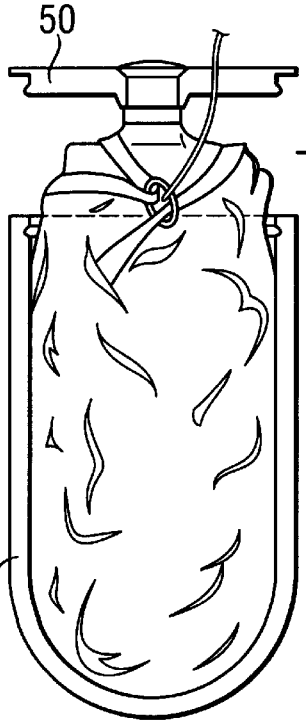

FIG. 19: View of cylindrical body of life preserver without side openings, open.

Figure 20:
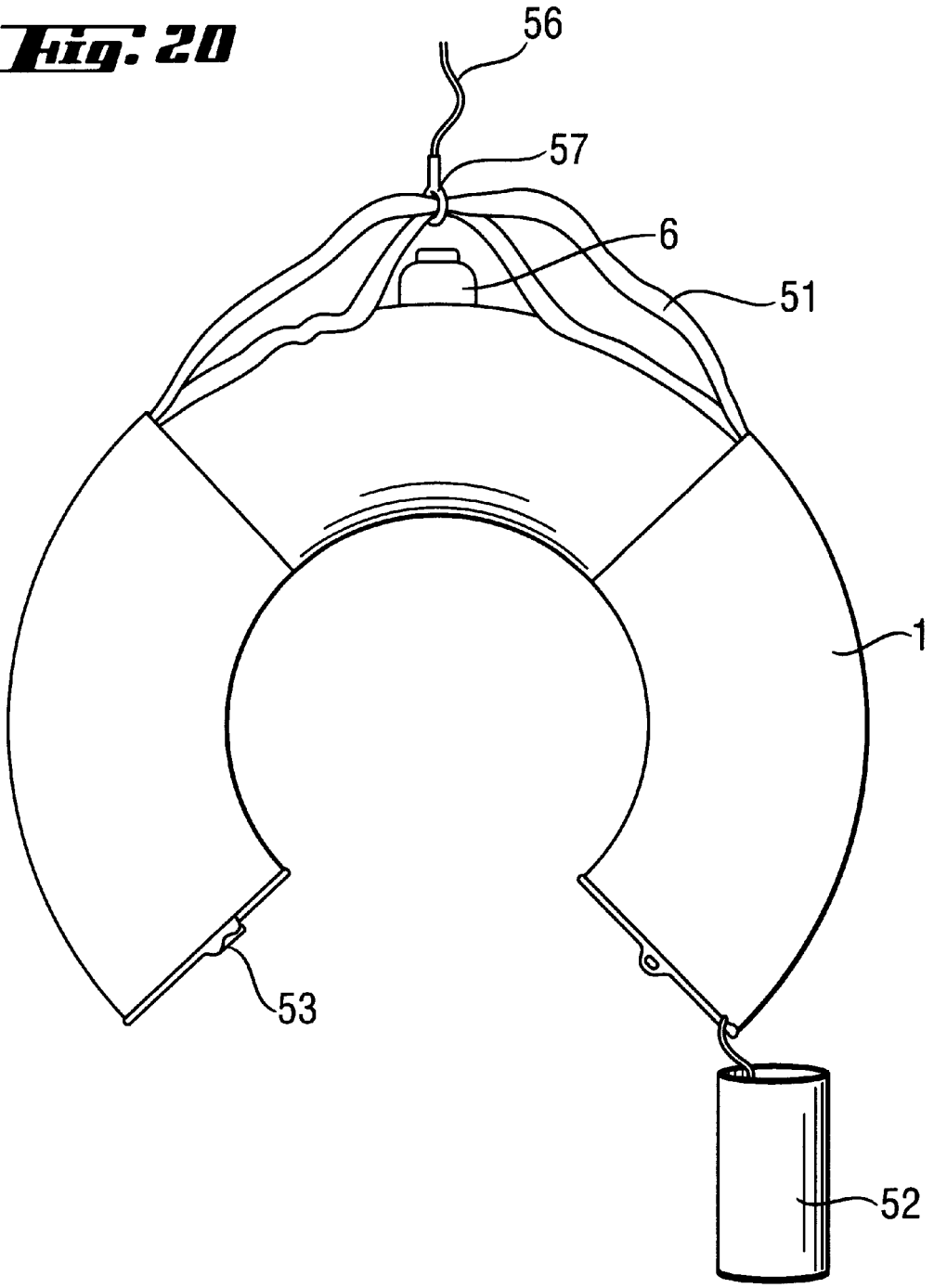

FIG. 20: Side view of entire inflated life preserver.

Figure 21:
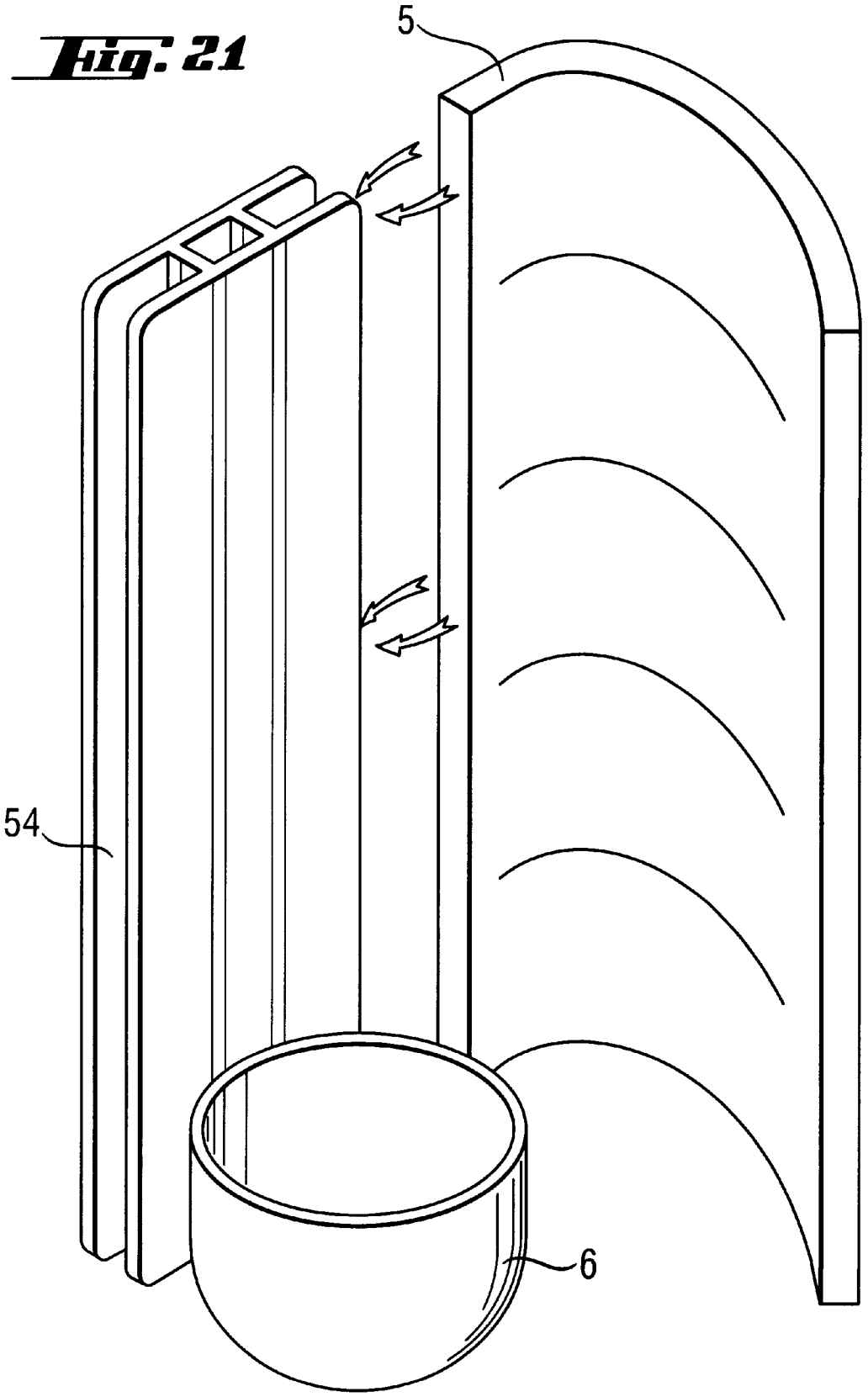

FIG. 21: Drawing showing fitting exterior layer to guide.

Figure 22:
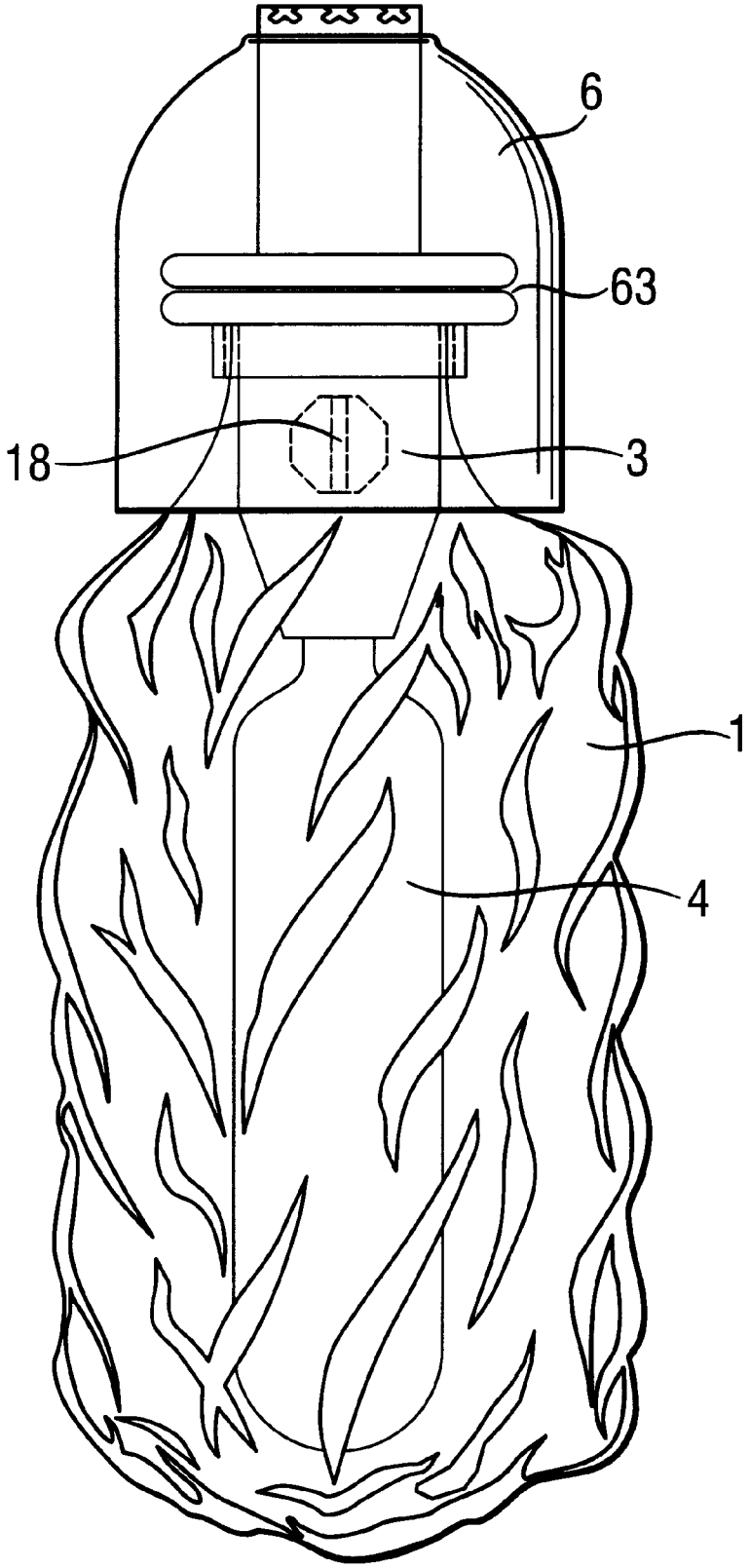

FIG. 22: View of inner body of life preserver.

Figure 23:
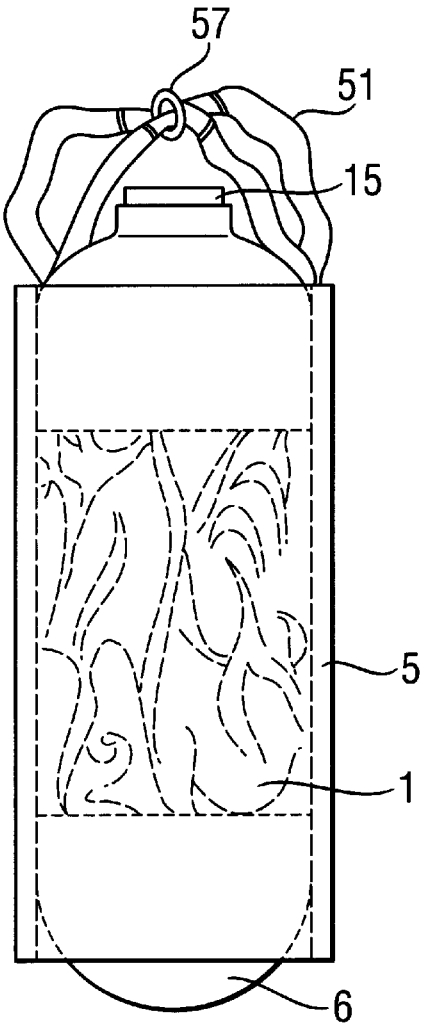

FIG. 23: Front view of life preserver without covers.

Figure 24:
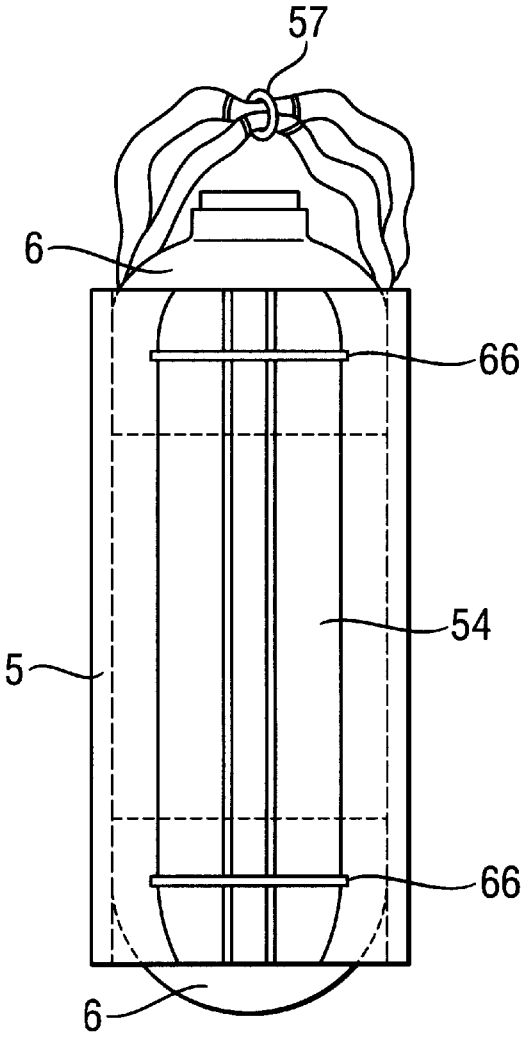

FIG. 24: Back view of life preserver without covers.

Figure 25:
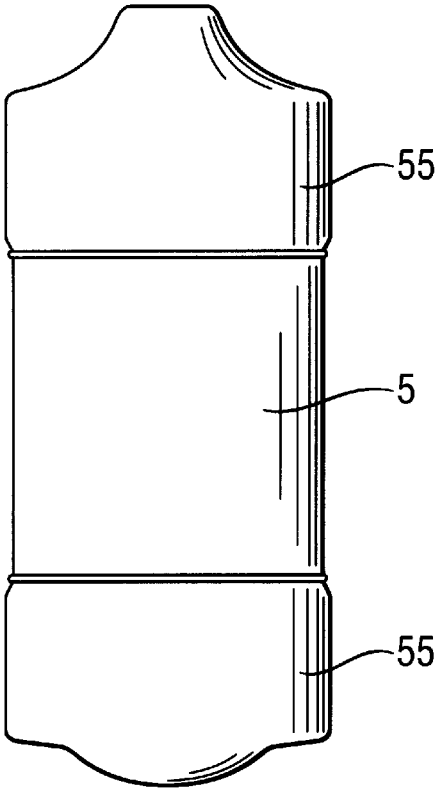

FIG. 25: Front view of life preserver with covers.

Figure 26:
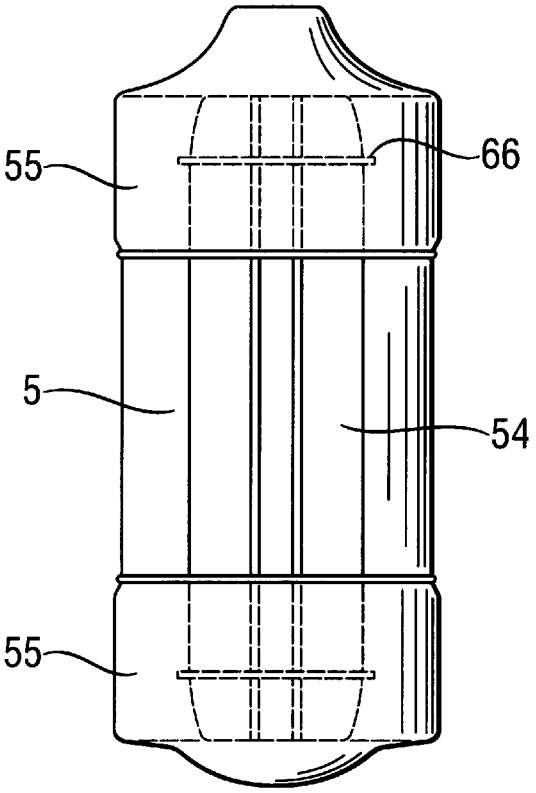

FIG. 26: Back view of life preserver with covers.

Figure 27A:
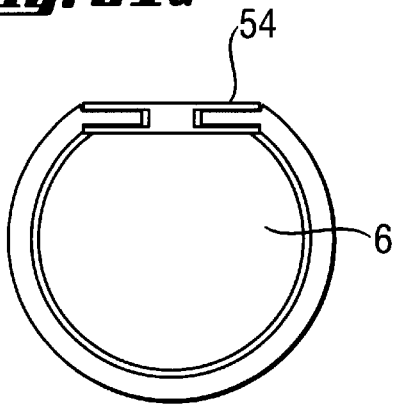
Figure 27B:
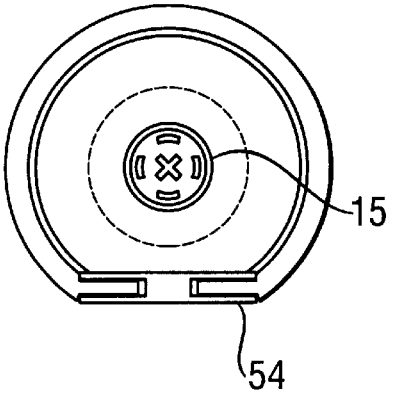

FIGS. 27(*a* and *b*): Top and bottom view of life preserver without covers.

Figure 28A:
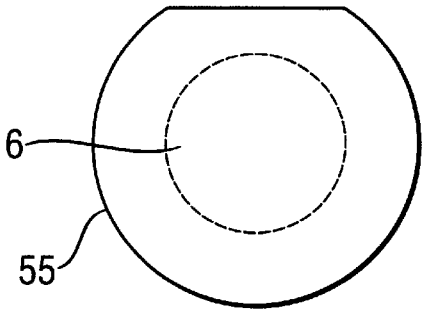
Figure 28B:
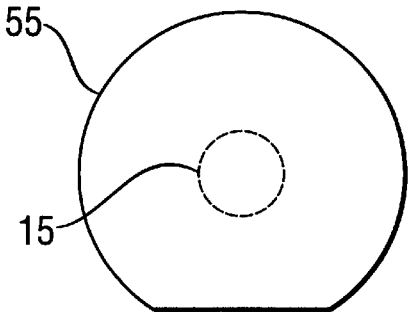

FIGS. 28(*a* and *b*): Top and bottom view of life preserver with covers.

Figure 29:
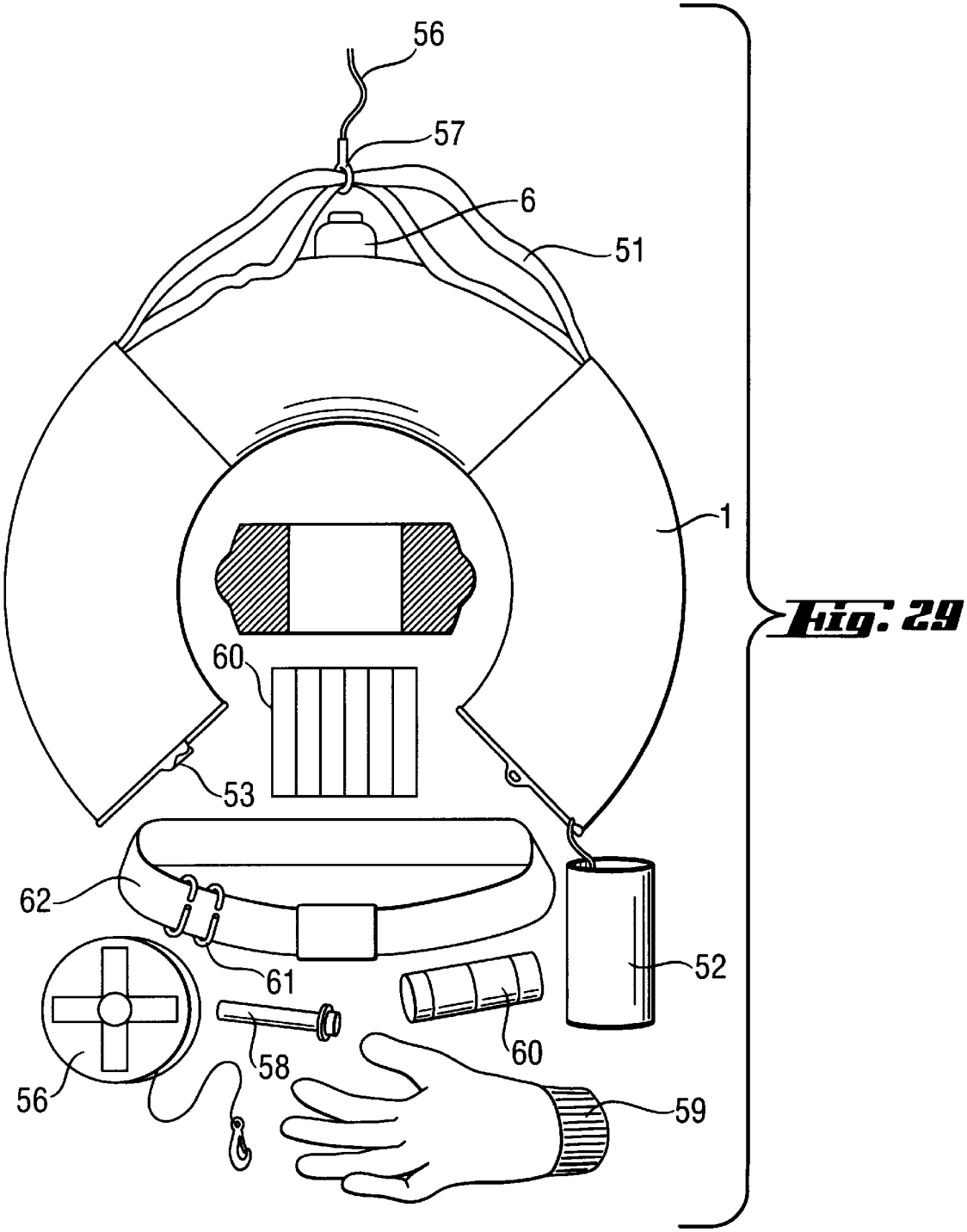

FIG. 29: Full view of entire rescue system comprising the object of the patent for which application is being made.

Figure 30:
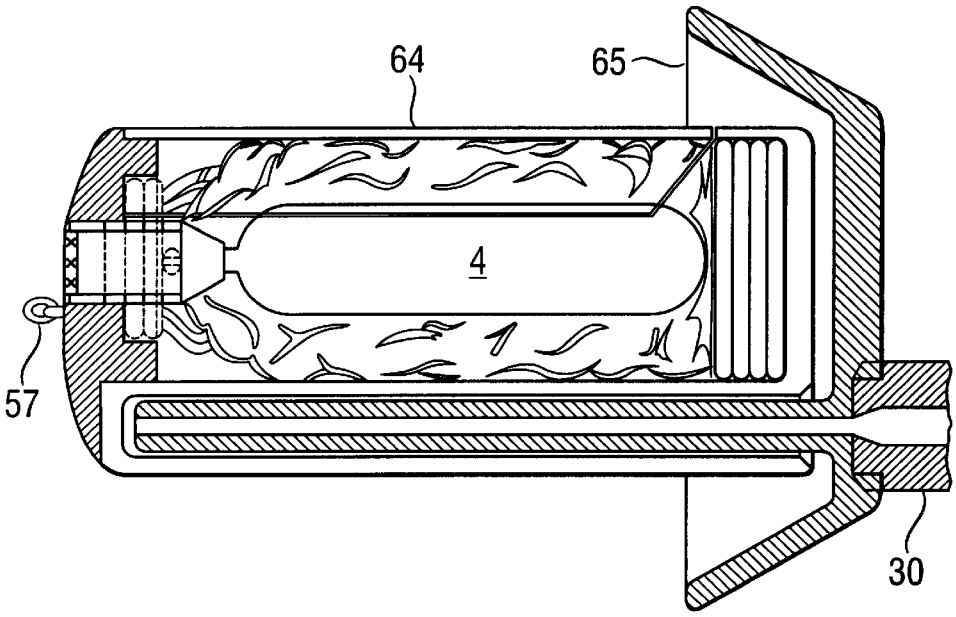

FIG. 30: Partial view of manual hookup of life preserver to small-mouthed launcher.

Figure 31:
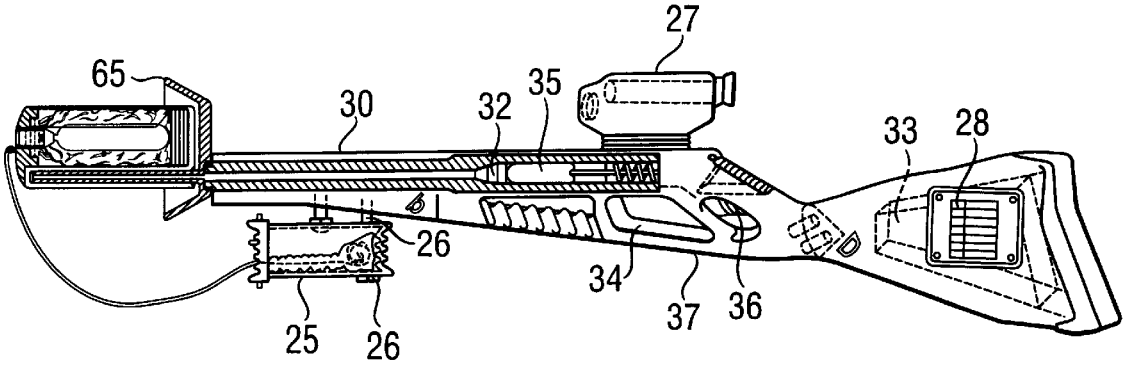

FIG. 31: Side view of launcher incorporating entire life preserver.

According to the Figures attached hereto, as has been previously mentioned hereinabove, it can be said that this life preserver system is comprised of two main parts, that is, the life preserver per se and the life preserver propulsion or launching mechanism.

As is detailed in FIG. 1 and in FIG. 5, the life preserver is comprised of two main parts, one mainly made of rubber or latex or of a similar material to ensure the buoyancy thereof, and a second part, preferably made of metal, including different mechanisms. It is in the rubber portion where the deflated float (1) is kept, being equipped with different valves for the intake of air or gas (2) in addition to a main air valve (3) running directly from the compressed air or gas tank (4) included in the metal part of this item. This area is joined and secured to the metal area by means of a rigid plate with which it is equipped on the inside through the center from which the main valve (3) is made to run. The entire float is kept inside a type of somewhat more rigid cover (5), the upper part of which, which is also made of rubber is a cap (6), from which two phosphorescent ties (7) made of nylon or of a similar material hang, which, in conjunction with the other tie which crosses them on the diagonal, secure or gather the entire float into one sole compact package, temporarily securing it into place with some rubber thrums or stops (8) to the mid-section of the life preserver. At the top part of the cap is a rubber relief (9) to provide instructions, which is used to guide the mechanism with circular movements which it would cause itself as shown on the drawing which reroutes the air to one side on the cap, making the float turn. This self-turning system is rounded out with two overhangs in the form of porches or flaps (10) situated exactly opposite one another and also setting the direction of the steering path. These flaps would be connected to the interior and to the exterior of the cap. The float per se is equipped with an additional safety layer on the inside which would open up in the event that any of the two parts of the float were to be punctured, it sufficing with the other, being possible to be re-inflated by means of the different valves intended for use (11) in the event of emergency.

The metal part to which the float is attached is comprised mainly of gas tank (4) and two mechanisms designed so that the system float will inflate, be it by mechanical means or, alternatively, by means of a water sensor. The gas tank (4) is specially-shaped and houses the two gas or air-feeder systems in a recess located at the bottom of the tank. These two systems overlap one another, being linked to one another lengthwise, given that the rod of the lever at the top makes its way through the center of the zone despite the fact that this is where the automatic inflating mechanisms similar to those already existing on the market is located.

This life preserver float can be inflated either manually or automatically.

To use this life preserver in the delayed manual inflating mode, all one has to do it turn the lever (12) slightly to move it from the "safety" setting to the "quiescent" setting. At this point, one can either directly press the first level and wait for a delayed inflation or, alternatively, can press all the way down, giving rise to an instant emergency inflation. For using the mechanical mode with the launching mechanism, it will suffice to switch from the "Safe" setting to the "Quiescent" setting. On being fired from the muzzle (13) of the launcher, the pressure of the gases per se will move the lever (12) down to the second level and remain there, allowing time enough for the projectile to go even longer distances.

The automatic water sensor-operated system (15) shown in FIGS. 2, 3, 5 and 6 is activated by means dissolving of a salt tablet (16) in the same manner as some of the sensors which are currently used in the marketplace. As of this point, for the case at hand, the functioning of this apparatus is as is explained in following. The main mechanisms of the sensor is enclosed in an unsealed receptacle which is equipped with small openings or holes at the bottom and which is either rubberized, metal or reinforced, given that due to long-range, lasting use, dust particles can collect on it as a result of its being used with a launcher.

After the life preserver has been launched and the water has seeped in through the holes, the small receptacle containing this mechanism will begin to fill with water. On the water coming into contact with the tablet, the tablet will dissolve within a few seconds, giving rise to the spring which it had underneath that was pressed into a metal box secured to the base (17) being released. After this occurs, the rod located at the center of the mechanism shifts position, moving far enough to open a valve, which is the main valve of the gas tank, and directly hooks up with the internal base of the float, as a result of which the item in question will be inflated within a few seconds' time.

These two systems, the manual or the mechanical system and the automatic sensor-operated system are optional for functioning separately or in combination with one another, a distinction being automatically made between one and the other for the sake of fast action by means of two notches (18) made at different points along the section of the rods which cause the gas valve to open. If, at any point in time, any of these systems must be used, the first one which is enabled will drag the end of the rod enabling the second use along with it. Just as the case of either the manual or mechanical system being able to remain on the safety setting, it suffices for the automatic system to have a simple rubber cover which fits over the holes at the bottom of the sensor so that this sensor can be immersed underwater without inflating as a result thereof.

Another possibly major improvement is that of installing a water sensor (15) of the features described hereinabove in the area of the steering butts located on the side (10), given that, without making any change in the steering system, a simple double-ported valve (19), the gas system can be kept open constantly by means of a flexible tube (20) coupled to the float by means of any of the gas outlet valves (2). It suffices for the sensor to be enabled so the float to in turn enable the flow of air closed up to that point in time directly linked to the inflatable life preserver by means of the gas tank tube.

The launching system is shown in FIGS. 10, 11, 12 and 13. This system is basically a high-powered, completely immersible, detachable propulsion unit comprised basically of a barrel (30) and the butt (33), unserviceable for any caliber balls and which is equipped with the mechanisms basic to any firearm but entails some engineering design features which distinguish it from other guns and which make it useful and apt for use by the public at large. This system functions as described in following. The ring on the string attached to the life preserver (21) is taken and is joined to the ring on the end of the string (23) of the roll stand (25) which is affixed to the launcher proper. Following the launching of the life preserver, it suffices to wait for the victim to grasp onto the life preserver to pull in the string (23). At this time, the person manning this system needs only to turn the crank (26) built into the line roll stand (25).

Despite its infantile or simple appearance, this implement employs exclusive gauging systems resulting in the development of a high-trajectory firing system pinpointing the mark in most cases.

As a note, special mention is made of a recent-generation telemetric gauge (27) being installed approximately where a telescopic sight would be located, which affords the possibility of knowing the exact distance at which the victim it is being attempted to rescue is located, with a margin of error of ±1 meter per 400 meters. After ascertaining the distance, the use of one single type of high-powered ammunition would provide the data required for being able to make the float fall exactly on the desired point.

It is solely necessary to provide the person manning this system with a chart (28) in a readily-visible location showing the distances achieved on firing at each and every one of the angles possible. This chart is affixed to the butt for fast, convenient use. This gun is also equipped with either a digital or manual a degree gauge (29), comprising an additional innovation, containing a certain amount of fluid not subject to changes due to the effects of heat or cold (antifreeze) as a level, shaped in form of a right-angle triangle-sided pyramid, where the hypotenuse in the base and plane of the barrel of the gun. On progressively pointing the gun upward to launch the float, the degree gauge would show a progressively higher reading. When the firing angle as indicated on the chart is reached, the shot must be fired to achieved the required distance, to which end it is solely necessary to pull the trigger and to subsequently carry out the pertinent measures to successfully complete the rescue process.

Worthy of special mention with regard to the aforementioned launcher is the incorporation of a screw-on muzzle (13) which can be attached to the end of the barrel (30) inside which the compact life preserver float (1) fits tightly for greater pressure is located. This muzzle (13) has a number of openings or holes (31) ranging from 4 to 6 in number, located at its base in the event that, in special situations or under special circumstances, it were to be necessary to fire a less powerful or more silent shot. This would be the case, for example, in which a risk of an avalanche or of a landslide were to be involved. Depending upon the number of holes which are left uncovered, another scale will be made to add to the data on the gun butt. Affixed to the opposite side of the butt are the graphs of the paths of the most common firing angles as well as the second path which the life preserver will foreseeably take. With the exception of firing at a 45° angle, all of the firing distances of the gun in question will have two possible firing angles. For example, for firing a shot at a 15° angle and another at a 75° angle, the distance traveled in both cases is the same. Nevertheless, to continue with this same example, the 75° angle will afford the possibility of avoiding a ship, reef or any other obstacle which may be involved. Likewise, for one same distance, short firing angles would be more advisable under strong wind conditions in order to prevent the projectile from drifting off course. The barrel (30) of the gun is smooth, has no scratches and detachable. Precisely as is detailed in FIG. 10, it also incorporates a number of conical filters which will prevent any caliber of ammunition from being fired. The conical shape (32) thereof affords the possibility of absorbing the entirety of all of the fumes caused as a result of the explosion of the blank cartridge, being attached across the mouth of the barrel, as a result of which, in addition to comprising an excellent safety system preventing any tampering with this gun (given that the filters are welded in place), the best possible use would be made of the existing pressure. This gun has been conceived based on a mid to long-range barrel, of a sturdy, highly streamlined build for an easy, continued TRARO. It is advisable that the body be synthetic or rubber in order to ensure its flawless working order under water, also being resistant to possible impacts as the result of everyday outdoor use. Spaces can also be left on the butt (33) and at the midsection (34) for stowing first-aid kits or gun-cleaning kits, additional floats or other auxiliary items. On doing away with the snap-on doors at the mid-section, it is possible to tow applying a greater deal of force using the same gun as a structure to which the cord or line is to be attached. The ammunition-loading system (35) is preferably located on the side so as to allow the telemetric or other gauges to be more readily slipped over it, and equipped with a single-fire mechanism, with a conventional trigger with a built-in safety bolt (36) and is not equipped with an exceedingly large number of automatic devices which are, on the other hand, unnecessary, given that apart from making this gun more difficult to handle as the result of entailing greater prospects of faults occurring, would also add to the cost of this item, which is not advisable, given that, due to the features thereof, this is an item indicated as a good for public use. The ammunition-loading mechanism (35), the trigger (36) and the muzzle (31) are perfectly well-equipped to be immersed by means of the action of some pressure seals (37) with rubber gaskets, which are easy to detach.

FIG. 8 and FIG. 9 provide the details of the structure of the roll stand (25), at the bottom of which, at the end on which the string is wound (23), a part is installed which is similar to a bright-colored daisy or rosette which shoots out when the cable on the roll stand (25) runs out. Given its light weight, buoyancy and the easy with which it is visible, this rosette marks the end of the line for easy recovery. If it were to be affixed to the roll stand (25), when the line ran out, even though solely a few meters ahead of time, it would be impossible to come to the aid of the victim. Hence, it is always possible to go out in the water the few meters the rosette has gone to retrieve if for the rescue operation. The aforementioned rosette is kept folded up inside the roll stand and will open up on touching the water, given that its ends are subject to the action or a salt washer or threading similar to that of the automatic firing device. When it opens up, it exposes a combined grooved rubber surface and hooks running in one sole direction made of a sturdier material, which will afford the possibility of retrieving the entire system lost from the shoreline without having to go into the water. It is only necessary to fire a compact life preserver with the inflating systems disabled by means of the lever (12) and the cover. It suffices to make it go over the first line of cord and by pulling on it against the current or undertow until the floating rosette is retrieved, which, thanks to its hooks running in one single direction, will afford the possibility of the line being caught in any of them as the result of the least degree of pressure being exerted from he shoreline. Finally, it suffices to pull on this second line or cord to retrieve both lines, specifically performing the rescue. Obviously, this system is effective as a conventional lifeline. This line will be bright-colored and will be marked every certain number of meters. For longer-distance firing, it suffices to harder the outer casing and to add counter-weights.

Sufficieth it to say that with the system described hereunder, in which the position of the automatic sensor is independent of that position or location of the tank, many different shapes and designs of compact floats are possible, be they due to practical or fanciful reasons, from a simple ball equipped with a round gas tank and the sensor on the outside, to a simple arrow with the system previously described likewise adapted. For cases involving dire emergencies or extremely long distances, valid solely for special missions and military operations, life preservers, jackets or boats with inflating systems of the type described hereunder could be supplied embodied as follows: a metal ball shaped similar to a canon ball and divided into two symmetrical halves with an air chamber in between the two shared by the two halves and likewise almost symmetrical. It suffices to fill the first space before the air chamber and to vacuum-lock the ball using a simple valve from which a small little hole would be visible from the outside. If suffices to create the vacuum from the outside until the two halves are firmly secured and which would open up following the long-range firing after the water sensor being triggered, which would supply a small amount of gas to the chamber so that it would open, releasing the package fired for opening and inflating.

In keeping with the aforesaid Figures, the outside ties can be eliminated from most common model for beaches and long-distances, the entire outer layer being finished off in an attachment guide (54) (FIG. 21) into which the edged of the aforementioned layer will be inserted, being held in place by the pressure created. This guide or safety mechanism can be comprised of one or more sections Up to the ends of the guide, some edgings made of rubber or a similar material (66) (FIG. 24), as well as some rabbets around the entire edge of the layer (5) (FIG. 21), all of which is to prevent water from flowing in, are optional.

After inserting both side edges lengthwise along the full length of the guide, a cylindrical or nearly cylindrical body will be formed depending upon the type of guide (54) employed. Attached to the bottom of the guide is one of caps (6) (FIG. 21) such that once the outer layer has been secured in place, the entire body (52) (FIGS. 18–19–29) becomes a vessel or receptacle into which the life preserver as such is to be inserted, closing off this assembly of the top cap (6) (FIG. 20) which would be secured temporarily to the water sensor (15) (FIGS. 23–24) and to the neck of the life preserver, leaving the former of the two exposed through a centrally-located opening. Hence, with the exception of on the sensor, this entire assembly of the body provides what is located inside it with a high degree protection against water flowing inside it (FIG. 23, FIG. 24). It is in this section that the ring (57) for attaching the float-pulling ties (51) (FIGS. 23–24) will be housed.

This section is completed with the covers (55) made of latex, rubber or a similar material to totally ensure its complete watertightness. Additionally, this section floats, which is highly practical in the event of possible leaks in rough waters or in bad weather (FIGS. 25, 26 and 28).

Whenever a distress call is received from the water, all that has to be done is remove the protective rubber covers (55) and throw it within reach of the person in need. A few seconds after hitting the water, the sensor (15) (FIGS. 23–24) will be triggered, the ring (18) located at the center of the mechanism moving far enough to open the main valve (3) (FIG. 22) of the gas tank (4) which is hooked up directly to the inside base of the float, as a result of which, this item will be inflated by means of $CO_2$, compressed air or any other gas within a few short seconds, the tank thereof being reusable or not, as is convenient, such that the sensor being triggered will enable, in turn, the flow of the air enclosed up until this point in time and is directly connected by means of the gas tank tube to the inflatable life preserver.

Once the gas intake from the tank has been opened, as the result of the tank being located inside the body of the float per se, the float will immediately be inflated, the float pressing on the outer walls (5) (FIG. 21) which, in turn, will emerge as a result of the pressure of the guide (54) (FIG. 21), affording the possibility of the opening of the inside assembly, comprised mainly, apart from the mechanical parts, of two basic components: a watertight float, creased by a highly flexible, high-strength (polyurethane or similar) rubbery plastic coating which would be covered in a thin, high-strength fabric, be it nylon or a similar fabric. The coating can be dual-chamber with two blowers for cases of emergency involving air leakage. Due to its components, this coating prevents possible punctures or damage, whether they be caused by fingernails of nervous accident victims, rubbing against rocks, sharp objects or any other customary risk involved in sea rescues.

The entire assembly is housed compactly inside, thus preventing any bypass valves and trouble for occupants. The gas bottle (4) (FIG. 22) is replaced through the float neck opening, subsequently being tightly closed by means of a specially-designed thread or attached clamp (63) (FIG. 22) provided for this purpose. The gas bottle can also be closed through the end of one of the float arms, providing for a perfectly watertight seal.

The result is that the victim is provided with a large, fully-inflated float within his/her reach within a few seconds of having called out for help. Due to the fact that the float (1) (FIG. 22) is horseshoe-shaped, it is much easier to grab hold of, given that by simply pulling it up to his/her body, the victim is held tight from the back. Additionally, it can also be closed off along the back with a nylon tie secured or tied off in a similar fashion (53) (FIGS. 20–29), as a result of which, the victim, already safe, only has to get out of the water with a life preserver.

If the person to be rescued is relatively far from shore, and it is felt that he/she may have problems even with the life preserver on, the following steps must be taken. Use a roll of heavy-duty line (59) (FIG. 10) equipped at the end with a safety hook and attach to the ring (57) (FIG. 30) concealed up to this point in the area of the top cap of the body (6). If suffices to tug gently on this ring to expose some ties made of nylon or of a similar material (51) which are specially-stitched, in turn, to a double reinforcement fabric at the front of the life preserver, being thus positioned to spread the pressure of the pulling involved, the rigid plate inside the float being optional. Once the safety hook has been clipped onto the ring (57) of the pulling ties (51), the only thing which has to be done is to throw the life preserver within reach of the victim (FIG. 23, FIG. 24). At the same time that this item is launched, let the heavy-duty line go, which will unroll easily thanks to the tube equipped with a stop (58) (FIG. 29), which is used as a shaft running through the roll stand (56) (FIG. 29). Once the accident victim has grasped onto the life preserver (1), one may employ the non-slip glove or gloves (59) (FIG. 29) provided in the rescue worker's kit to pull on the line to preclude injuring one's hand, when pulling the victim to the shore. The entire assembly is packed onto a belt using flexible ties (69) (FIG. 29), rings (61), etc. for convenient, secure, efficient carrying and use.

Just as with regard to the life preserver described in the first part of this patent, the ties surrounding the cylinder or ball for purposes of holding the same into place can be done away with, thus affording the possibility, for better securing the contents thereof, of inserting the body into a closed object without any side openings such that on the life preserver inflating, it will emerge through the part of the cylinder where the cap or cover is located due to the pressure built up, given that the cap or cover also comes off under the impact of the pressure exerted by the float, as is detailed in FIG. 18 and FIG. 19. The ends of the cylinder can be reversed in use, leaving the cap area as the base of a concave protective cylinder (52) (FIGS. 18–19) and the other end used as a detachable cover of the entire assembly (50), housing the end of the water sensor (FIG. 18 and FIG. 19) in a central opening. Although both outer ends of the assembly can be the same (flat, concave, convex, etc.), it is advisable that a distinction be made between the two for optimum, safe service. The water can be shielded with a cover similar to those previously described (55) (FIG. 25—25).

The finished appearance, in both cases, would be quite similar to that which is shown in FIG. 20. Therefore, as a summary, gas tanks or bottles (4) (FIG. 22) equipped with either one or two outlets or valves are feasible, it thus being possible to separate these two mechanisms (automatic or manual) in order to put each one or one alone at one end of the life preserver body or wherever it is intended to be installed. Likewise, the push-button for turning on the gas can be pointed on the end to thus be used as a pointer (18) (FIG. 22) for the gas bottles (4), it being possible to use water sensors of the type already sold on the market. Both these and the cylinder shapes previously mentioned are adaptable so that the gas is given off with the tank installed inside the float. Closing of the system with a larger-sized bypass valve which will afford the possibility of refilling or replacing the gas tank, and that on its being enclosed inside the float proper, will afford the possibility of reducing the problems involved in rerouting the gas, given that a small intake is left for the plunger or needle to fit into (18), but without the possibility of any gas leaking out thanks to some small rubber stops surrounding it. Likewise, the finishing touch on the assembly will be that of the float connected to the water sensor with a clamp and/or thread serving as a link (63) (FIG. 22). All of the component parts can be changed in order or shape to give rise to the same assembly, all of the external components shall be of suitable shape and texture to prevent any major injury to the accident victim.

For purposes of providing for a greater deal of safety with regard to pulling in or "fishing out" victims, apart from the rigid plate on the inside of the float, which serves as added support for pulling on the entire assembly, a couple of nylon ties can be attached in the form of handles around the full breadth of the fabric and reinforced doubly at the front, as is detailed in FIG. 20, thus being affixed to ensure and spread the pulling pressure without it being possible for this item to undergo any type of damage. Likewise, the manual launching, just like that which is done using the launcher, can be accompanied by a heavy-duty line for facilitating the recovery of the inflatable body and of the victim. On this being a horseshoe-shaped float, it fits up to the victim more readily and can be easily closed off using a cord, ring or similar element.

As far as the life preserver launching device is concerned, its muzzle can be made unique by adding some teeth to it which will match the grooves on the life preserver body. To be launched by the launcher, the coating of the life preserver must either be metal or made of another high-strength material, it thus being possible for it to be inserted directly into either the large muzzle or the small one, both of which are optional on the end of the launcher. The small muzzle can also be made unique by providing it with a cut profile other than circular (oval, triangular, etc., just like the attached tube) also providing a greater deal of stability as regards the securing of the life preserver. As an optional finishing touch on the launcher, the entire outer structure of the float will be inserted into the attached tube, as a result of which, when the shot is fired, the life preserver will be thrown in either of two ways. On landing on the water, the opening process is similar to the conventional manner, with a rigid cover (64) (FIG. 30) with the closure somewhat more heavy-duty, it being possible for them to be held in place with suitable adhesive or non-adhesive ties which change shape on coming into contact with the water or to turn and the cover giving way by pressure resulting in a fast opening on the pressure building from the inside. The entire assembly will finally be joined to the float just as in the preceding manner. To prevent injury due to explosion, the thin muzzle is supplied with a structure in the form of a pan (65) (FIGS. 30–31) as a protection of the occupant from the launcher.

Apart from the above and with regard to the launcher, said instrument (FIGS. 30–31) is subject to affording the possibility of the use or of eliminating equipment to cut costs or to provide for easier handling, such as, for example, replacing the standard butt with the folding one, as is detailed in FIG. 16 and FIG. 17, in addition to cutting down the size or of taking off some of the component parts thereof, such as the distance-gauging device, etc.

Further details are provided hereinbelow regarding the functioning which this innovation is advocating when the objective is that of launching over a very long distance, this being a system which, even with outer protections for preventing injuries on impact, is understood as being used solely in cases of dire need, such as that of ships adrift difficult to pinpoint, passengers following a shipwreck spread out over a distance of several kilometers, especially at night, military maneuvers, etc. Precisely as is detailed in FIG. 15, the external configuration of this innovation is a round or cylindrical body preferably made of metal or of some other heavy-duty material (38) with a completely smooth surface with the exception of several holes leading to the inside but without going beyond the edge of the ball, also including an almost unnoticeable slot which divides the ball into two practically symmetrical halves (39). Said ball houses the inflatable material (49) per se ready for launching, whether this material be a life preserver-float, an inflatable boat, etc., the main blower or air inlet valve (41) of which is connected to a four-way tube at the respective ends of which a number of components which are detailed in following are installed.

The first branch houses the water sensor (42) (FIG. 14) in one end, and the second one, which is located exactly opposite the first one, houses the air or gas inlet and outlet valve (43) of a closed device (44) for housing such a component.

The third branch of the tube is of a smaller diameter and likewise of a lesser thickness, in addition to be angled slightly differently from the other ends of the crosshead. This small tube (45) (FIG. 14) hooks up directly to a chamber (46) comprised when the two halves of the ball are joined together such that a vacuum chamber (46) is formed surrounding the entire inside of the object, coinciding with the slot or cut (39) which divides the ball into two halves (39) as a result of which, once said vacuum has been created inside this inner ring, the entire ball is tightly sealed and finished off with thin plastic or rubber gaskets so that the ball will withstand the strongest of thrusts or impacts. To trigger the functioning of the life preserver for which the claims are set forth hereunder, a projectile (38) (FIGS. 14–15) must be inserted, whether a ball or a cylinder, all the way into the barrel or mouth of the launcher, taking the precaution, for the better functioning of the system, of leaving the water sensor (42) to the outside thereof.

The shot will be fired when the firing angle has been calculated using the instruments and gauges provided for this purpose. At the moment at which the water comes into contact with the water-sensitive sensor (42), whether this sensor be of the tablet type, an electrically-operated valve or any other system, said sensor (42) moves inward, exerting pressure on the valve (43) which will release the gas from the tank (44) whilst raising a small valve (47) which, acting as a lock, had been keeping the vacuum chamber which was connected to the little tube or vacuum-release duct (45) covered by this valve sealed.

Precisely as is described in FIG. 15, on the pressure being exerted by the water sensor (42) being released, the gas flows toward the other branches of the connecting tube. Most of this gas will flow to the life preserver or inflatable boat valve, but a small portion will flow to the thin duct (45) connecting to the vacuum chamber, as a result of which this cavity ceases to be hermetically sealed to open up almost immediately after the first cubic centimeters of air flow into said cavity. Special mention must be made in this regard of the fact that the amount of air allowed to enter is limited both by the small diameter of the tube in question as well as by the greater degree to which the same is angled so that the pressurized air flowing out of the tank will encounter a larger number of obstacles hindering it from flowing through it, such that most of the air released from the gas tank will be routed through the tube connecting the inflating valve, finally completing the flow of gas into the inflatable body. On the vacuum chamber (46) being released and the two halves (38) of the ball or cylinder automatically split apart, the inflatable body can expand to its full size. Both the main valve (41) as well as the auxiliary feeder valve (48) allow air to flow through only in one direction, as a result of which, once the inflating process had ended, it will not be possible for the air to feed back in nor to flow out through the vacuum release tube (45), most of this gas therefore remaining inside the inflatable body. The body is attached to the float in the same way as for other life preservers.

Within the scope of the innovation which is being presented and for the purpose of facilitating the locating of the inflatable body, it is important to point out that both for the conventional system as well as for these more special cases of self-inflating launching, the use of accessories for viewing the position of these items can be highly useful, such as, for example, chemical glow wands or wands of other types, which would be added to the inside of the assembly already functioning before being launched and would provide for accurate vision for both the individuals to be rescued at nigh as well as for the rescue boats or helicopters. Sonar, radar or locating systems of any other type which can be easily integrated into the assembly described hereinabove may also be useful.

For the purpose of offsetting a possible lack of power on firing, the user can shorten the distance between him and the victim by means of the simple procedure of moving into the water at a safe distance and then firing from the chosen position. Given the nature and the features of the gun in question, which is completely immersible, it is only necessary to remove the cover from the muzzle.

This gun and the mechanisms of which it is comprised can be taken apart fast and relatively simply. Their structure and most of the body can be synthetic, as a result of which this operation will be carried out through the trap doors provided especially for this purpose and with a hermetic seal for the possible immersion thereof.

Additionally, worthy of mention is that for the purpose of preventing this life preserver from being carried along by the tide or the wind, ballast can be incorporated which is comprised of a simple bag made of plastic or of a similar material which is folded and tied to the structure, which will unfold on the system opening up, picking up a certain amount of water sufficing to act as ballast and guarantee the immobility of the life preserver system.

The patent of invention which is being advocated hereunder can be embodied, within the essentially thereof, in other forms, materials and sizes, which shall also come under the protection which is being sought in this patent and which will in no way alter in any case the spirit of the claims.

What is claimed is:

1. A life-saving device with launcher being configured basically in the form of a flotation means, such as an inflatable life preserver and a gun or launcher which thrusts the life preserver far away, said life preserver comprising:

a rubberized part housing a float 1, equipped with different air intake valves 2 as well as a main air valve 3 coming directly from a gas or compressed air tank 4 inside a metal portion of the life preserver, the rubberized and metal portions being joined together by the effect of a rigid plate located inside the same, through the center of which the main valve 3 runs such that said float is gathered into a generally rigid cover, the top part of which is a cap 6 from which a plurality of ties of a brightly colored nylon or a phosphorescent material 7 band which, in conjunction with another tie which crosses the same, secures or holds together the inflatable life preserver as a compact package, holding it in place temporarily with some rubber stops to a mid-section of the life preserver, and a top of said cap incorporating a rubber relief 9 which acts as a component auxiliary to a self-turning system, ending in two overhangs in the form of porches or flaps 10 situated opposite one another, which link the cap inside and out, providing the life preserver with a direction for its path.

2. The device according to claim 1, characterized in that said metal portion attached to said flotation means comprises:

a gas tank 4 and two float-inflating mechanisms capable of being manually, mechanically-operated or operated automatically by a water sensor, such that a manual inflating is triggered by a slight turn of a lever 12, and moving said lever from a "safety" setting to a "quiescent" setting, it being possible to either directly press a first level and to await delayed inflating or to press all the way down to give rise to an instant or emergency inflating operation, wherein using the mechanical mode entails the launching device, it being sufficient to change the "safety" setting to the "quiescent" setting, given that on launching from a muzzle 13 of the launcher, pressure of the gases will push the lever 12 down to a second level, where it will remain.

3. The device according to claim 2, characterized in that said water sensor system 15 is triggered as the result of dissolving a salt tablet 16, the main mechanism of said water sensor being located inside a receptacle having a plurality of small openings or holes therein, such that the tablet 16 dissolves on coming into contact with water, releasing a spring on which a metal structure attached to a base 17 has been exerting pressure up until that point, and moving a rod located at the center of said mechanism to open the main valve of the gas tank which is linked directly to an internal base of said flotation means for inflating same.

4. The device according to claim 2, characterized in that a generally cylindrical, hermetically-sealed bundle comprised of a wrapper section 52 housing said life preserver per se, closed by means of a pair of caps on ends 6 with the incorporation of said water sensor 15, all of which is rounded out with covers 55 made of a flexible or elastic material.

5. The device according to claim 2, characterized by the water sensor 15 being triggered upon coming into contact with water, through the shifting position of a ring 18 located at the center of said mechanism so as to open the main valve 3 of the gas tank 4 which is directly linked to the internal base of said floatation means, resulting in the immediate inflating of same by means of pressurized gas.

6. The device according to claim 2, wherein replacement of the gas tank 4 is made through the mouth of said floatation means which is subsequently closed using a screw-on cap 63.

7. The device according to anyone of claims 1 to 3, characterized in that said water sensor 15 is disposed near side steering-control caps 10 given that without making any change in the steering system, a two-port valve 19 keeps the gas system constantly open by means of a flexible tube 20, which is hooked up to said life preserver at any gas relief valves such that the water sensor being triggered will in turn trigger the flow of air which had been closed off up until this point and is linked directly by means of a gas tank tube to the inflatable life preserver.

8. The device according to anyone of claims 1 to 3, characterized in that the launcher comprises a propulsion unit having a barrel 30 and butt 33, such that when a ring on a line hooked up to the life preserver 21 is pulled in and is attached to a ring 22 at an end of a line 23 of the roll stand attached to the launcher, the float 1 is launched, for the recovery of which it suffices to turn a lever 26 incorporated into a line roll stand 25.

9. The device according to claim 8, characterized in that said propulsion unit incorporates a telemetric gauge 27 for setting a distance at which an accident victim to be rescued is located, and incorporating a chart 28 attached to the butt 33 showing distances reached on firing at various angles, and equipped with either a digital or manual degree gauge 29, so that, on angling the gun or launcher to fire the shot, the degree gauge 29 will raise the degree mark up to a point showing the exact distance to be covered, this being the point in time at which the trigger 36 is pulled to fire the floatation means.

10. The device according to claim 9, characterized in that the line roll stand 25 incorporates, at its bottom and at the end of the line 23, a part similar to a bright-colored daisy or rosette, which shoots out when the line roll stand 25 runs out, said daisy or rosette being stowed folded inside the line roll stand 25 and opening up on landing on the water, given that it ends are held into place by the effect of a washer or thread similar to that of an automatic firing device, exposing, when it opens, a combined rubber groove and hooks running in a single direction which enables recovering a lost launcher from a shoreline without having to get into the water, given that it is necessary to launch a compact life preserver with its inflation disabled by a lever 12 and the cover, coming up against the floating rosette, with hooks running in a single direction allow for the line to enter any of them as a result of the least pressure exerted from shoreline.

11. The device according to claim 10, characterized in that inflation of said life preserver may be employed using a metal ball divided into two symmetrical halves and a generally symmetrical air chamber in between the two halves which is shared by both halves, whereby a cavity is first filled prior to the air chamber and said metal ball is vacuum-sealed using a valve connected to the outside until the two halves are together tightly secured, the halves opening following launch after a water sensor is triggered, providing a small amount of gas to the air chamber so that it will open and release said floatation means fired for its opening and inflating in the vicinity of a victim adrift in a sea of water.

12. The device according to claim 9, characterized in that said launcher incorporates a muzzles which is screwed onto the end of the barrel, inside which the life preserver or floatation means in packed, and said muzzle having a number of small openings or holes ranging from 4 to 6 in number, located at the bottom thereof for the purposes of cutting down the power and noise of the shot fired, such that except at a 45 degree firing angle, all of the distances can be obtained based on two different firing angles, the shortest angles being chosen for straighter paths and the higher angles for firing over reefs or other barriers.

13. The device according to claim 12, characterized in that the barrel of the launcher is smooth and detachable, and includes a number of cone-shaped filters which permit the firing of any caliber of ammunition, the conical configuration absorbing the fumes given off as a result of the explosion of a blank cartridge, fitting up to the walls of the barrel, it being possible for the butt and a mid-section thereof to incorporate a number of cavities or spaces for stowing first-aid, gun-cleaning accessories, auxiliary floats or other accessories, the ammunition-loading mechanism preferably being located on the side, said loading-mechanism, the trigger and the muzzle being equipped for being immersed in water by means of pressure seals with readily detachable rubberized gaskets.

14. The device according to claim 13, characterized in that the line roll stand incorporates, at its bottom and at the end of the line, a part similar to a bright-colored daisy or rosette, which shoots out when the line roll stand runs out, said rosette being stowed folded inside the line roll stand and opening up on landing on the water, said daisy or rosette having ends that are held into place by a washer or thread similar to that of an automatic firing device, exposing when it opens a combined rubber groove and hooks running in a single direction which enables recovering a lost launcher from a shoreline without having to get into the water, given that it is necessary to launch a compact life preserver with its inflation disabled by a lever and a cover, coming up against the floating said daisy or rosette, with hooks running in a single direction allow for the line to enter any of then as a result of the least pressure exerted from the shoreline.

15. The device according to claim 14, characterized in that inflation of said life preserver may be employed using a metal ball divided into two symmetrical halves and a generally symmetrical air chamber in between the two halves which is shared by both halves, whereby a cavity is first filled prior to the air chamber and said metal ball is vacuum-sealed using a valve connected to the outside until the two halves are together tightly secured, the halves opening following launch after a water sensor is triggered, providing a small amount of gas to the air chamber so that it will open and release said floatation means fired for its opening and inflating in the vicinity of a victim adrift in a sea of water.

16. The device according to claim 8, characterized in that said launcher incorporates a muzzle 13 which is screwed onto the end of the barrel 30, inside which the life preserver or floatation means is packed, and said muzzle 13 having a number of small openings or holes 31 ranging from 4 to 6 in number, located at the bottom thereof for the purpose of cutting down the power and noise of the shot fired, such that, except at a 45° firing angle, all of the distances can be obtained based on two different firing angles, the shortest angles being chosen for straighter paths, and the higher ones for firing over reefs or other barriers.

17. The device according to claim 16, characterized in that the barrel 30 of the launcher is smooth and detachable, and includes a number of cone-shaped filters 32 which permits the firing of any caliber of ammunition, the conical configuration 32 absorbing the fumes given off as a result of the explosion of a blank cartridge, fitting up to the walls of the barrel 30, it being possible for the butt 33 and a mid-section thereof to incorporate a number of cavities or spaces for stowing first-aid or gun-cleaning accessories, auxiliary floats or other accessories, the ammunition-loading mechanism 35 preferably being located on the side, said loading-mechanism 35, the trigger 36 and the muzzle 13 being equipped for being immersed in water by means of pressure seals 37 with readily detachable rubberized gaskets.

18. The device according to claim 17, characterized in that the line roll stand incorporates, at its bottom and at the end of the line, a part similar to a bright-colored daisy or rosette, which shoots out when the line roll stand runs out, said rosette being stowed folded inside the line roll stand and opening up on landing on the water, said daisy or rosette having ends that are held into place by a washer or thread similar to that of an automatic firing device, exposing when it opens a combined rubber groove and hooks running in a single direction which enables recovering a lost launcher from a shoreline without having to get into the water, given that it is necessary to launch a compact life preserver with its inflation disabled by a lever and a cover, coming up against the floating said daisy or rosette, with hooks running in a single direction allow for the line to enter any of then as a result of the least pressure exerted from the shoreline.

19. The device according to claim 18, characterized in that inflation of said life preserver may be employed using a metal ball divided into two symmetrical halves and a generally symmetrical air chamber in between the two halves which is shared by both halves, whereby a cavity is first filled prior to the air chamber and said metal ball is vacuum-sealed using a valve connected to the outside until the two halves are together tightly secured, the halves opening following launch after a water sensor is triggered, providing a small amount of gas to the air chamber so that it will open and release said floatation means fired for its opening and inflating in the vicinity of a victim adrift in a sea of water.

20. The device according to claim 1, including a roll of heavy-duty line 56 equipped at its ends with a safety hook for hooking said line onto a ring 57 provided on the top cap of the body, said line unwinding up to the point of the device reaching the vicinity of the person in danger in the water for the purpose of the rescue thereof, the device being retrieved by means of pulling in the line and rolling it up on a reel.

21. The device according to claim 1, wherein said gun or launcher includes a launching device 30 equipped with means of propulsion, means for loading a projectile for thrusting the device, a tubular extension insertable into a cylindrical hole in the body of the life preserver device, and protection means for the launcher comprised of a pan the axis of which coincides with the axis of the life preserver.

22. The device according to claim 21, characterized in that the launcher includes means for sighting 27 and setting the firing, a joint for optionally folding the butt, and a recess for stowing 28 extra projectiles.

* * * * *